US005465931A

United States Patent [19]

MacDonald

[11] Patent Number: 5,465,931

[45] Date of Patent: Nov. 14, 1995

[54] MECHANISM FOR RELIEVING STRESS ON THE HANDS OF A PERSON OPERATING A COMPUTER KEYBOARD

[76] Inventor: Ray C. MacDonald, R.F.D. #3, Box 804, Skowhegan, Me. 04972

[21] Appl. No.: 225,771

[22] Filed: Apr. 11, 1994

[51] Int. Cl.[6] ..... B63G 5/00

[52] U.S. Cl. ..... 248/118.3; 248/918; 248/346.06; 248/286.1

[58] Field of Search ..... 248/118, 118.1, 248/118.3, 118.5, 346, 918, 279, 276, 286; 400/715

[56] References Cited

U.S. PATENT DOCUMENTS

| | | | |
|---|---|---|---|
| 2,801,142 | 7/1957 | Adams | 5/623 X |
| 4,913,390 | 4/1990 | Berke | 248/118.3 X |
| 4,976,407 | 12/1990 | Schwartz et al. | 248/118.3 |
| 5,058,840 | 10/1991 | Moss et al. | 400/715 X |
| 5,104,073 | 4/1992 | Van Beck et al. | 248/285 X |
| 5,161,760 | 11/1992 | Terbrack | 248/118 |
| 5,211,367 | 5/1993 | Musculus | 248/279 |
| 5,215,282 | 6/1993 | Bonutti | 248/118.3 X |
| 5,219,136 | 6/1993 | Hassel et al. | 248/118 |
| 5,375,800 | 12/1994 | Wilcox et al. | 248/118.1 |
| 5,398,896 | 3/1995 | Terbrack | 248/918 X |

*Primary Examiner*—Karen J. Chotkowksi
*Attorney, Agent, or Firm*—Frederick R. Cantor

[57] ABSTRACT

A mechanism for relieving stress on the hands of a person operating a computer, is provided by a panel adapted to be anchored to the underside of a conventional computer keyboard. A hand-support bar is located in front of the computer keyboard, between the front ends of two swingable arm structures pivotably attached to the panel alongside the keyboard. The hand-support bar can be raised or lowered by swingably adjusting the arm structures. Each arm structure has an adjustable length, so that the hand-support bar can be moved toward or away from the front edge of the keyboard. The hand-support bar is rotatably adjustable around a longitudinal axis located near its lower edge, such that the upper surface of the bar can have a desired engagement with the palm area of the person's hand.

9 Claims, 2 Drawing Sheets

MECHANISM FOR RELIEVING STRESS ON THE HANDS OF A PERSON OPERATING A COMPUTER KEYBOARD

BACKGROUND OF THE PRESENT INVENTION

1. Field of the Invention

The present invention relates to a mechanism for resting the hands of a person operating a computer keyboard.

The present invention, more particularly, relates to a mechanism mountable on a computer keyboard for relieving stress on the hands and wrist of a person operating the keyboard. The mechanism is an attachment usable with a range of conventional keyboards.

2. Prior Developments

It is known to provide bar-like support mechanisms in front of typewriters, or computer keyboards, for supporting a person's hands while the person is typing or operating the keyboard. In many cases however, such support mechanisms lack adjustments that will provide the desired comfort or support for a reasonably large percentage of the people using the typewriter or keyboard. The conventional support mechanisms are a compromise, that may not fully meet the needs of most typists, (keyboarders).

U.S. Pat. No. 4,709,972, issued to B. La Budde et. al, on Dec. 1, 1987, discloses a cabinet for a keyboard, wherein the keyboard is mounted on a slidable tray for movement into, or out of, the cabinet. The front wall of the tray can be swung down to form a support for the hands of the person operating the keyboard. The hand-support structure has only one operating position, as depicted in FIG. 4 of the patent drawing. The hand-support structure lacks features of adjustability, as would enable it to conform to different size hands and different human preferences.

U.S. Pat. No. 4,688,862, to D. Fowler et. al, discloses a vertically extensible support bar used in conjunction with a touch video screen. Vertical adjustments of the support bar is apparently for the purpose of making the bar comfortable for persons having differing physical characteristics. The patentee indicates that the person can rest his or her arm, elbow, or hand, on the bar (or pad) while using the touch video screen. There is no indication in the patent that the adjustable bar could be used with a typewriter or computer keyboard.

U.S. Pat. No. 2,950,890, to O. Hough shows an adjustable arm rest usable with a typewriter. The rest structure of the Hough patent is not designed to support the typists hands.

SUMMARY OF THE PRESENT INVENTION

An objective of the present invention is to provide a mechanism for resting the hands of a person operating a computer keyboard.

A further objective of the present invention is to provide an adjustable mechanism specifically designed to provide a rest, or support, for a person's hands while the person is operating a computer keyboard. The mechanism has provisions for clamping the mechanism to a conventional computer keyboard, such that the keyboard is prevented from shifting, or sliding, during the time that the keyboard is in use.

The anti-slide feature is of some importance when it is realized that conventional keyboards are relatively light and easily displaced from a given position, e.g., due to the person inadvertently applying pressure to the front edge, or a side edge, of the keyboard housing. By clamping the hand-rest mechanism to the keyboard, any slight shifting of the keyboard on the table, or desk, is ineffective to disturb the relation between the keyboard and the hand-rest mechanism.

The hand-rest mechanism preferably comprises a panel adapted to underlie a conventional keyboard, together with clamping means for clamping the panel to the keyboard. The clamping mechanism can comprise two spaced parallel rails movable toward each other on the panel for clamping engagement with the end surfaces of the keyboard.

The hand-rest mechanism includes two parallel arm structures located outboard from the keyboard, and mounted for arcuate swinging adjustments in vertical planes normal to the front edge of the aforementioned panel. An elongated hand-support bar extends between the front ends of the adjustable arm structures in front of the keyboard. The hand support bar is coextensive with the transverse side-to-side dimension of the keyboard, such that the person can move his or her hands transversely across the keyboard while still keeping in contact with the support bar. Typically the support bar will have a length of about eighteen (18) inches, i.e., slightly longer than the transverse dimension of a conventional keyboard.

The aforementioned arm structures are swingably adjustable to raise or lower the horizontal support bar to positions deemed most comfortable by most persons who might use the keyboard. Typically the arm structures are arcuately adjustable, in unison, through an arc of about thirty (30) degrees, so that the hand-support bar has a raised position located above the plane of the keyboard support panel, and a lowered position located above the plane of the support panel. Various intermediate positions of the hand-support bar are achievable, depending on the type of locking mechanism used for locking the arm structures in selected positions of adjustment. Preferably, the hand-support bar can be set in at least three different positions of adjustment, i.e., a raised position, a lowered position, and an intermediate position.

The swingable arm structures are preferably constructed as extensible—contractible structures having variable lengths, whereby the hand-support bar 20, can be moved toward, or away, from the front edge of the computer keyboard. Typically, each arm structure will comprise a tubular sleeve and a rod telescopically slidable in the sleeve, whereby the length of the sleeve-rod assembly can be adjusted to bring the hand-support bar toward the keyboard or away from the keyboard.

The horizontal hand-support bar preferably comprises a strip of resilient elastomeric material extending the full length of the bar. The resilient strip has a convex arcuate upper surface engagable with the palm area of the person's hands to provide a soft comfortable relationship between the hand and the support bar.

Preferably the hand-support bar is rotatably joined to the aforementioned swingable arm structures, such that the bar upper surface can be oriented to the position of optimum comfort for the particular person using the computer keyboard.

By way of summarization, the invention contemplates a hand rest mechanism adapted to be clamped to a conventional keyboard, so that the relationship between the keyboard and the hand rest mechanism is not disturbed by shifting of the keyboard on the table or desk. The hand rest mechanism comprises a horizontal hand-support bar extending in front of the keyboard between the front ends of two spaced supporting arm structures extending forwardly from a support panel underlying the keyboard. The arm structures are swingable, in unison, in vertical arcs, for raising or lowering the hand-support bar. Each arm structure has an adjustable length, whereby the hand-support bar can be adjusted toward, or away, from the front edge of the keyboard. Preferably, the hand-support bar is rotatable around its longitudinal axis, such that the resilient upper surface of the bar can be oriented to a position of optimum comfort for each particular person using the keyboard.

In summary, and in accordance with the above discussion, the foregoing objectives are achieved in the following embodiments.

1. A mechanism for relieving stress on the hands of a person operating a computer keyboard, comprising:

a panel adapted to underlie a computer keyboard;

means carried by said panel for releasably anchoring the keyboard on the panel;

said panel having a front edge paralleling the front edge of the keyboard when the keyboard is positioned on the panel;

two parallel spaced arm structures, each arm structure having a rear end located above the panel, and a front end located forwardly beyond the panel front edge;

pivot means carried by said panel at the rear end of each arm structure for swingably adjusting said arm structures in vertical planes normal to the panel front edge; and a horizontal hand-support bar extending between the front ends of said arm structures, whereby said bar is raisable or lowerable in front of the keyboard when said arm structures are swingably adjusted.

2. The mechanism, as described in paragraph 1, wherein said hand-support bar has a convex arcuate upper surface presentable to the person's hand; and means rotatably connecting said hand-support bar to said arm structures, such that the bar upper surface can have a range of different positions relative to the person's hand.

3. The mechanism, as described in paragraph 2, wherein said hand-support bar comprises a strip of resilient elastomeric material extending the full length of the bar to define said convex arcuate upper surface.

4. The mechanism, as described in paragraph 1, wherein said arm structures are adjustable in unison between a raised condition wherein the hand-support bar is located above the plane of said panel, and a lowered condition wherein the hand-support bar is located below the plane of said panel.

5. The mechanism, as described in paragraph 4, wherein said arm structures are adjustable through an arcuate distance of approximately thirty (30) degrees.

6. The mechanism, as described in paragraph 4, and further comprising means for locking said arm structures in at least three (3) positions of adjustment.

7. The mechanism, as described in paragraph 1, wherein said keyboard anchoring means comprises two (2) spaced parallel rails located on said panel, each rail extending normal to the panel front edge; and said rails being adjustable toward or away from each other for clamping engagement with end surfaces of a keyboard positioned on the panel.

8. The mechanism, as described in paragraph 1, wherein each arm structure comprises two (2) arm structure components movably connected for adjusting the arm structure length.

9. The mechanism, as described in paragraph 1, wherein each arm structure comprises a tubular sleeve component forming the rear end of the arm structure, and a rod component forming the front end of the arm structure; and each said rod component being slidably telescoped into the associated sleeve component, whereby the length of the respective arm structure can be varied to move the hand-support bar toward or away from the front end of said panel.

A BRIEF DESCRIPTION OF THE DRAWINGS

DESCRIPTION OF THE PREFERRED EMBODIMENTS OF THE PRESENT INVENTION

Figure 1:
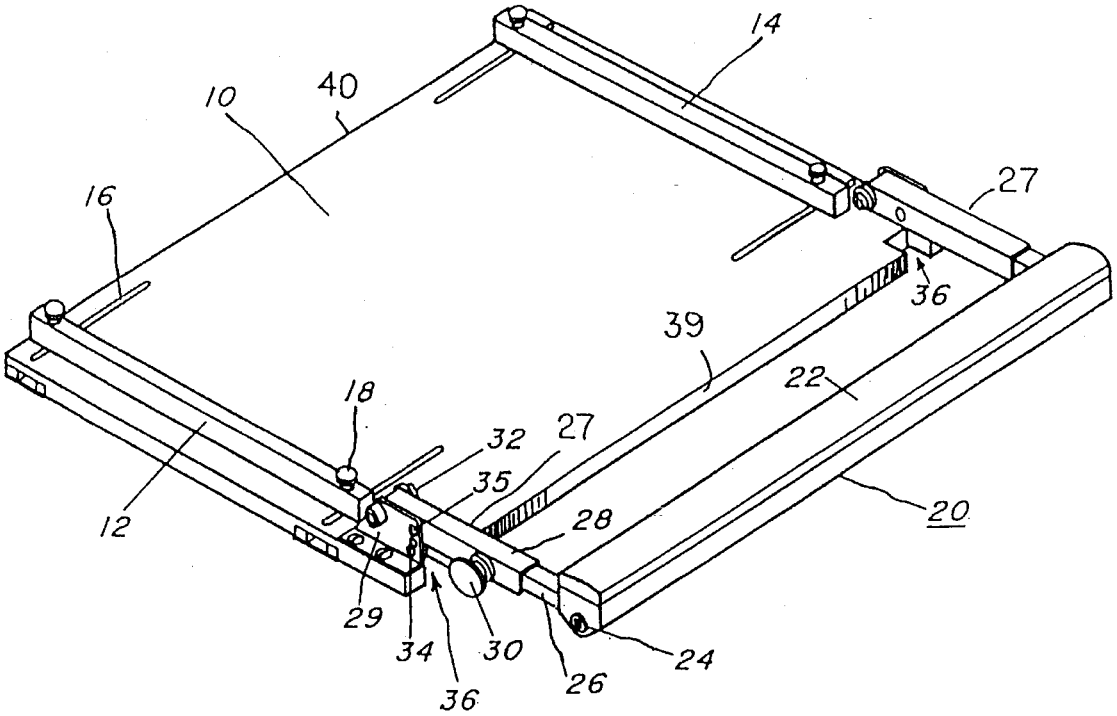
FIG. 1, is a perspective view of a mechanism constructed according to the present invention.

FIG. 1, is a perspective view of a mechanism constructed according to the present invention.

Figure 2:
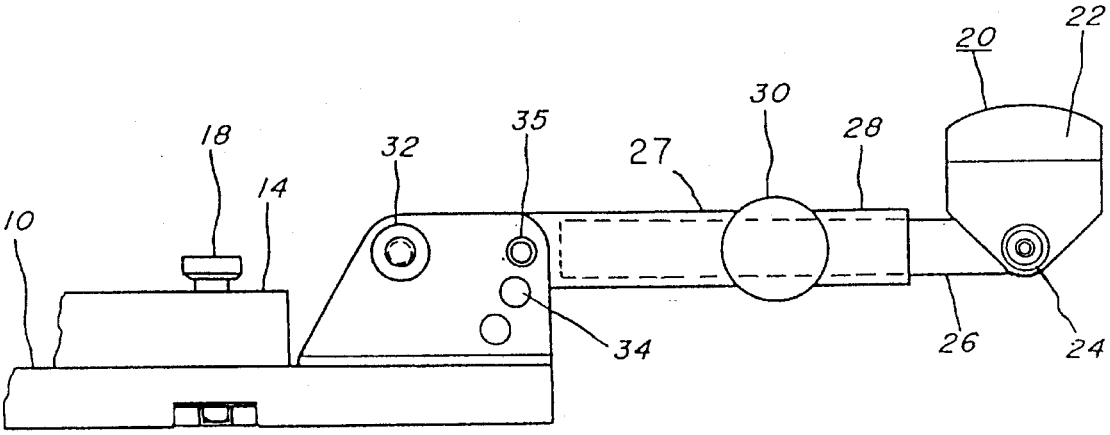
FIG. 2, is an enlarged fragmentary side elevational view of the FIG. 1 mechanism.

FIG. 2, is an enlarged fragmentary side elevational view of the FIG. 1 mechanism.

Figure 5:
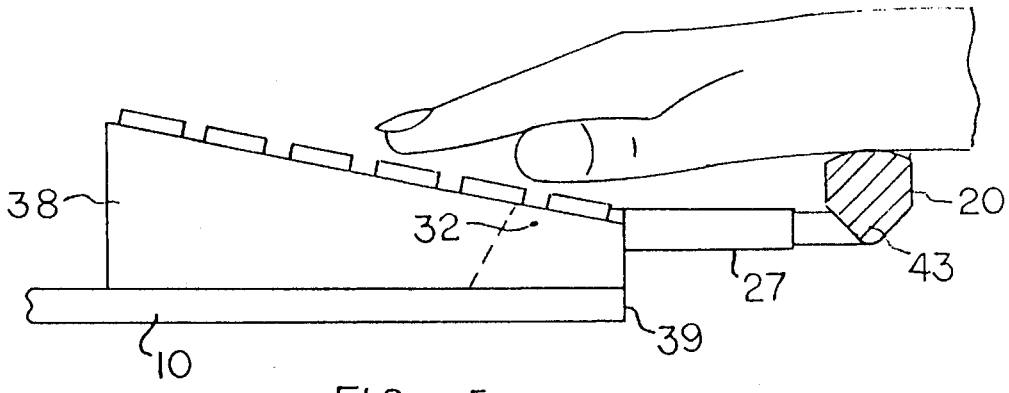
FIGS. 5 and 6, are fragmentary diagrammatic views showing how a hand-support bar in the FIG. 1 mechanism can be raised or lowered to meet the requirements of different persons operating the keyboard.
Figure 6:
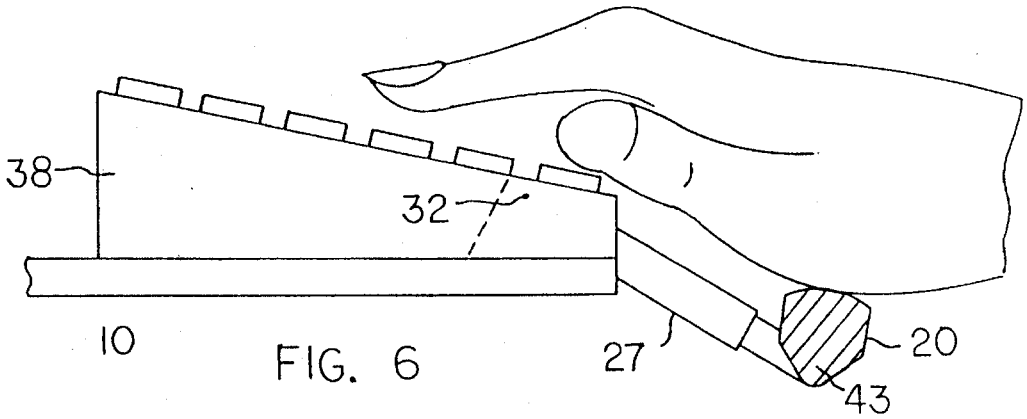

FIGS. 1 and 2, illustrate a mechanism designed to relieve stress on the hands of a person operating a computer keyboard. A representative keyboard 38 is depicted in FIGS. 5 and 6. As shown in FIGS. 1 and 2, the stress-relief mechanism comprises a flat panel 10, adapted to underlie the computer keyboard 38 locatable between two rails 12 and 14. Rails 12 and 14 extend in a front-to-rear direction, i.e., normal to the front and rear edges 39 and 40 of panel 10, whereby the rails 12 and 14 can abut against the end surfaces of the computer keyboard 38.

Panel 10 has two sets of slots 16 running parallel to the panel front edge 39 for adjustment of rails 12 and 14. Screws 18 extend through the rails 12 and 14 into slots 16.

Figure 3:
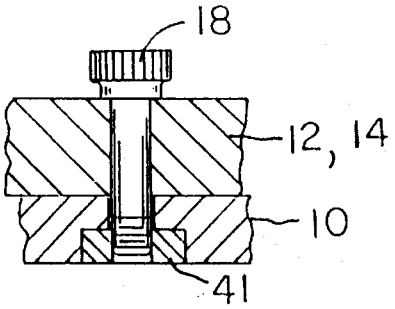
FIGS. 3 and 4, are fragmentary sectional views illustrating structural details used in the FIG. 1 mechanism.
Figure 4:
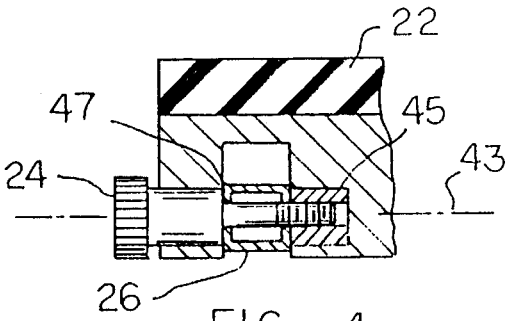

FIGS. 3 and 4, are fragmentary sectional views illustrating structural details used in the FIG. 1 mechanism.

As shown in FIG. 3, the threaded end of each screw 18 meshes with a threaded hole in a shoe 41, that is slidable in a track coextensive with the associated slot 16. When screw 18 is turned, the associated shoe 41 acts as a clamp to hold rail 12 or 14 in a desired position of adjustment on panel 10. The rails 12 and 14 have clamping engagement with end surfaces of the computer keyboard 38 to releasably anchor the keyboard 38 to panel 10.

Two parallel spaced arm structures 27 extend forwardly above panel 10 in directions normal to the panel front edge 39. Each arm structure 27 has a rear end pivotably connected to a bracket 29, whereby the arm structure 27 can swing in a vertical plane normal to the panel front edge 39. A pivot pin 32 extends through bracket 29 and the rear end of arm structure 27 to provide the swing adjustment of the arm structure 27. The front ends of arm structures 27 are rotatably joined to a horizontal hand-support bar 20, so that the support bar 20 is located in front of the keyboard.

FIGS. 5 and 6, are fragmentary diagrammatic views showing how a hand-support bar in the FIG. 1 mechanism can be raised or lowered to meet the requirements of different persons operating the keyboard.

FIGS. 5 and 6 illustrate the disposition of support bar 20 relative to a conventional computer keyboard 38 anchored to panel 10.

FIGS. 2 and 5, show hand-support bar 20 in a raised position located above the plane of panel 10. FIG. 6, shows the hand-support bar 20 in a lowered position located below the plane of panel 10. One or more intermediate positions of the hand-support bar 20 are possible, depending on the locking mechanism used to selectively hold the arm structures in different positions of adjustment. As shown in FIGS. 1 and 2, the locking mechanism comprises a lock pin 35 adapted to extend through a selected hole 34 in bracket 29, and an aligned hole in arm structure 27, whereby the arm structure 27 is held in its adjusted position. The drawing shows three (3) holes 34 in each bracket 29, hence three positions of adjustment for the associated arm structure 27. However, the number of adjustment holes or settings can be greater, if so desired.

Arm structures 27 are adjusted in unison so that hand-support bar 20 has a horizontal position in any selected position of adjustment. The length of adjustment may be about thirty (30) degrees, measured around the pivot pin 32 axis. FIGS. 5 and 6, illustrate the limits of a suitable adjustment range for hand-support bar 20. Clearance slots 36 in the front edge of panel 10 enable arm structures 27 to swing downwardly to the FIG. 6 positions.

Each arm structure 27 has an adjustable length, whereby the hand-support bar 20 can be moved toward, or away from, the front edge of panel 10 (and hence the front edge of keyboard 38). In the illustrative drawing each arm structure 27 comprises rear tubular sleeve 28 and a forward hollow rod component 26 slidably telescopically inserted into the sleeve 28, whereby the rod 26 can be moved into, or out of, the sleeve to vary the length of arm structure 27. A set screw 30 is provided for locking rod component 26 in selected positions of adjustment.

Hand-support bar 20 comprises a soft resilient elastomeric strip 22 extending the full length of the support bar 20 to form an arcuate convex upper surface adapted to underlie the palm area of the person's hand, as shown in FIGS. 5 and 6. Hand-support bar 20 is rotatably joined to arm structure 27 for rotary adjustment around a longitudinal axis 43 located near the lower edge of the support bar 20. Such a rotary adjustment somewhat enhances the comfortability of the convex curved cushion surface on the person's hand when support bar 20 is in a raised or lowered position. The aim is to provide a relatively slight contact area between the hand and the cushion, such that the person's hand muscles can perform without undue restraint by the support bar 20.

FIG. 4, shows one pivot construction that can be used to rotatably connect hand-support bar 20 to rod components 26 of arm structures 27. A screw 24 extends transversely through a hole in rod component 26 into a threaded insert 45 in bar 20. By tightening the screw 24 the shoulder 47 on the screw 24 can clamp rod component 26 to bar 20. Loosening the screw 24 permits the support bar 20 to be adjusted to different positions, as desired. The pivot construction of FIG. 4 can be used at both ends of bar 20.

The present invention, described above, relates to MECHANISMS FOR RELIEVING THE STRESS ON THE HANDS OF A PERSON OPERATING A COMPUTER KEYBOARD. Features of the present invention are recited in the appended claims. The drawings contained herein necessarily depict structural features and embodiments of the MECHANISM FOR RELIEVING STRESS ON THE HANDS OF A PERSON OPERATING A COMPUTER KEYBOARD, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A mechanism for relieving stress on the hands of a person operating a computer keyboard, comprising:

a panel adapted to underlie a computer keyboard;

means carried by said panel for releasably anchoring the keyboard on the panel;

said panel having a front edge paralleling the front edge of the keyboard when the keyboard is positioned on the panel;

two parallel spaced arm structures, each arm structure having a rear end located above the panel, and a front end located forwardly beyond the panel front edge;

pivot means carried by said panel at the rear end of each arm structure for swingably adjusting said arm structures in vertical planes normal to the panel front edge; and a horizontal hand-support bar extending between the front ends of said arm structures, whereby said bar is raisable or lowerable in front of the keyboard when said arm structures are swingably adjusted.

2. The mechanism, as described in claim 1, wherein said hand-support bar has a convex arcuate upper surface presentable to the person's hand; and means rotatably connecting said hand-support bar to said arm structures, such that the bar upper surface can have a range of different positions relative to the person's hand.

3. The mechanism, as described in claim 2, wherein said hand-support bar comprises a strip of resilient elastomeric material extending the full length of the bar to define said convex arcuate upper surface.

4. The mechanism, as described in claim 1, wherein said arm structures are adjustable in unison between a raised condition wherein the hand-support bar is located above the plane of said panel, and a lowered condition wherein the hand-support bar is located below the plane of said panel.

5. The mechanism, as described in claim 4, wherein said arm structures are adjustable through an arcuate distance of approximately thirty (30) degrees.

6. The mechanism, as described in claim 4, and further comprising means for locking said arm structures in at least three (3) positions of adjustment.

7. The mechanism, as described in claim 1, wherein said keyboard anchoring means comprises two spaced parallel rails located on said panel, each rail extending normal to the panel front edge; and said rails being adjustable toward or away from each other for clamping engagement with end surfaces of a keyboard positioned on the panel.

8. The mechanism, as described in claim 1, wherein each arm structure comprises two arm structure components movably connected for adjusting the arm structure length.

9. The mechanism, as described in claim 1, wherein each arm structure comprises a tubular sleeve component forming the rear end of the arm structure, and a rod component forming the front end of the arm structure; and each said rod component being slidably telescoped into the associated sleeve component, whereby the length of the respective arm structure can be varied to move the hand-support bar toward or away from the front end of said panel.

* * * * *